US005943986A

United States Patent [19]

Kern et al.

[11] Patent Number: 5,943,986

[45] Date of Patent: Aug. 31, 1999

[54] ENGINE HEAT EXCHANGE APPARATUS WITH SLIDE-MOUNTED FAN CARRIER ASSEMBLY

[75] Inventors: Robert D. Kern, Waukesha; Gerald C. Ruehlow, Oconomowoc, both of Wis.

[73] Assignee: Generac Power Systems, Inc., Waukesha, Wis.

[21] Appl. No.: 09/019,625

[22] Filed: Feb. 6, 1998

[51] Int. Cl.[6] ..... F01P 7/00

[52] U.S. Cl. ..... 123/41.49; 123/41.48; 123/41.11

[58] Field of Search ..... 123/41.48, 41.49, 123/41.11; 165/41, 51, 122; 474/109, 133, 135

[56] References Cited

U.S. PATENT DOCUMENTS

| | | | |
|---|---|---|---|
| 1,153,372 | 9/1915 | Churchward | 474/87 |
| 1,210,178 | 12/1916 | Lane | 474/117 |
| 1,301,784 | 4/1919 | Calkins | 123/41.49 |
| 1,598,274 | 8/1926 | Flagg | 123/41.49 |
| 2,004,151 | 6/1935 | Angstman | 165/69 |
| 3,202,144 | 8/1965 | Nicholson et al. | 123/41.49 |
| 3,358,655 | 12/1967 | Camps | 123/41.15 |
| 3,868,992 | 3/1975 | Getz et al. | 165/51 |
| 4,285,676 | 8/1981 | Kraft | 474/135 |
| 4,445,583 | 5/1984 | Mazur | 180/68.1 |
| 4,473,362 | 9/1984 | Thomey et al. | 474/135 |
| 4,518,373 | 5/1985 | Roth | 474/109 |
| 4,689,037 | 8/1987 | Bytzek | 474/135 |
| 4,698,049 | 10/1987 | Bytzek et al. | 474/135 |
| 4,725,260 | 2/1988 | Komorowski et al. | 474/133 |
| 5,006,094 | 4/1991 | Leonard | 474/101 |
| 5,078,657 | 1/1992 | Spell et al. | 474/109 |
| 5,195,932 | 3/1993 | Hirai et al. | 474/135 |
| 5,290,207 | 3/1994 | Yamamoto et al. | 474/109 |

*Primary Examiner*—Henry C. Yuen
*Assistant Examiner*—Hai Huynh
*Attorney, Agent, or Firm*—Jansson, Shupe, Bridge & Munger, Ltd.

[57] ABSTRACT

A liquid-cooled IC engine is in combination with a heat exchange apparatus therefor and the apparatus includes a radiator and a belt-driven fan. In the improvement, a pair of fan support stanchions are fixed with respect to the radiator and a fan carrier assembly is slide-mounted with respect to them. In a highly preferred embodiment, there are two springs urging the assembly for translational movement in a belt-tensioning direction. A tube-like arbor is mounted with respect to the panel and a bearing-supported shaft extends through the arbor and couples the fan and a driven fan pulley to one another. A flexible belt is driven by the crankshaft pulley and drives the fan pulley. The crankshaft pulley rotates at engine speed and has a first diameter and the fan pulley has a second diameter greater than the first diameter. The fan pulley (and the fan) rotate at a speed less than engine speed, thereby reducing fan noise.

20 Claims, 5 Drawing Sheets

ENGINE HEAT EXCHANGE APPARATUS WITH SLIDE-MOUNTED FAN CARRIER ASSEMBLY

FIELD OF THE INVENTION

This invention relates generally to internal combustion engines and, more particularly, to engines having fans for cooling liquid by air flow.

BACKGROUND OF THE INVENTION

Many types of internal combustion engines are liquid cooled and use a finned radiator through which hot engine coolant is routed to give up its heat to the atmosphere. And, typically, a rotating fan blows air through the radiator for heat exchange purposes. In a liquid-cooled engine, it is common to drive the fan at engine crankshaft speed. Liquid-cooled engines having radiator-type heat exchangers and fans for flowing air across such heat exchangers are used in such applications as motor vehicles and standby engine-generator sets used to provide emergency power for facilities such as hospitals, schools and the like.

It is well known that the horsepower available from an internal combustion engine is a function of torque (which, in turn, is a function of engine displacement) and speed. The equation expressing horsepower in terms of torque and speed is also well known.

A way to obtain greater horsepower from an engine is to increase its speed and/or its displacement. And given an engine of a particular displacement, higher horsepower can be obtained by running the engine at higher speed. But when the cooling fan is mounted directly to the engine, faster engine speeds are attended by faster fan speeds and, necessarily, higher fan blade tip velocity, even though the increased fan speed is not needed to provide adequate cooling. The result is a noticeably-increased (and objectionable) noise level resulting from the fan.

Earlier workers in the field are not unaware of ways to change fan rotation speed relative to engine speed nor of the fact that high fan speed produces objectionable noise. For example, U.S. Pat. No. 3,763,835 (Miller et al.) discloses an engine cooling fan, the blades of which extend radially to maximum length when the fan is running at slower speed. And at higher fan speed, the blades become shorter because of a centrifugal, weight-actuated camming arrangement. A stated reason for the arrangement is to reduce high speed fan tip noise.

U.S. Pat. No. 2,995,295 (Day) discloses an arrangement for changing fan drive speed as a percentage of engine speed. The pulley concentric with the fan has two pulley members, the relative axial positions of which can be changed to change the effective diameter of the pulley.

In the arrangement disclosed in U.S. Pat. No. 3,872,842 (Medley), both the driving and driven pulleys are capable of having their effective diameters changed. Pneumatic controls are used for the purpose.

Earlier designers in the field of belt-driven fan have also appreciated that belt tension needs to be maintained to help assure that the fan rotates at the proper rate, that the belt does not wear too rapidly and that other components contacted by the belt are properly driven. For example, U.S. Pat. No. 4,285,676 (Kraft) discloses an idler pulley mounted on a pivoting lever arm. Belt tension is maintained by the pulley. The lever arm is urged in a belt-tensioning direction by torsional coil springs. Other types of V-belt tensioning devices are disclosed in U.S. Pat. Nos. 4,445,583 (Mazur) and 4,518,373 (Roth) and others.

While these prior art arrangements have been satisfactory for the intended purpose, they are not without disadvantages. One involves mechanical complexity with seemingly-attendant propensity toward failure. The arrangement of the Miller et al. patent is an example.

Another disadvantage of certain prior art arrangements involves the matter of control of effective pulley diameter. The Medley patent discloses a pneumatic control arrangement which uses valves and temperature sensors to control fan speed.

Yet another disadvantage of certain prior art arrangements is that they do not fully appreciate how to reduce fan tip noise and provide automatic belt tensioning in a single mechanical arrangement. Using separate mechanisms for each purpose adds complexity to the engine/radiator combination.

An improved engine heat exchange apparatus for both automatically tensioning the fan drive belt and reducing engine fan noise while yet avoiding complexities of certain prior art arrangements would be an important advance in the field of engine cooling.

OBJECTS OF THE INVENTION

It is an object of the invention to provide an improved heat exchange apparatus which reduces engine fan noise and addresses some of the problems and shortcomings of the prior art.

Another object of the invention is to provide an improved heat exchange apparatus which automatically tensions the drive belt and addresses some of the problems and shortcomings of the prior art.

Another object of the invention is to provide an improved heat exchange apparatus which both reduces engine fan noise and automatically tensions the drive belt.

Yet another object of the invention is to provide an improved heat exchange apparatus which is mechanically straightforward.

Another object of the invention is to provide an improved heat exchange apparatus which reduces engine fan noise while yet avoiding the need for control equipment.

Still another object of the invention is to provide an improved heat exchange apparatus which reduces engine fan noise and is easy to use with existing internal combustion engines. How these and other objects are accomplished will become apparent from the following descriptions and from the drawings.

SUMMARY OF THE INVENTION

The invention involves the combination of a liquid-cooled internal combustion (IC) engine and a heat exchange apparatus therefor. The engine has an auxiliary engine shaft for, e.g., driving a pump, and also has a crankshaft pulley coupled to and rotating with the engine crankshaft at engine speed. The heat exchange apparatus including a radiator and a belt-driven fan. (While the pump is often referred to as a "water pump," it actually pumps engine coolant comprising, usually, about a 50—50 mixture of water and ethylene glycol, i.e., anti-freeze.)

The improvement comprises a fan support fixed with respect to the radiator. A fan carrier assembly has the fan mounted thereon and such assembly is slide-mounted with respect to the support. A force member, e.g., a spring, urges the assembly in a belt-tensioning direction. The improvement permits the designer to run the fan at a speed significantly less than engine speed and also provides automatic belt tensioning.

In more specific aspects of the invention, the fan support includes spaced-apart, "post-like" first and second stanchions which are parallel to one another. The fan carrier assembly includes an elongate rectangular panel extending between the stanchions and having spaced-apart first and second panel mounting portions. The mounting portions are slide-mounted with respect to the first and second stanchions, respectively, for translational movement with respect to such stanchions.

In a specific embodiment, panel slide mounting is by first and second pin-and-slot mechanisms. Either such mechanism may have a pin fixed with respect to a stanchion and a slot in the corresponding mounting portion. Or, less preferably, the pin is fixed with respect to a mounting portion and the slot is in the corresponding stanchion.

It is preferred that movement of the fan carrier assembly be translational rather than pivotal. This is so since the heat exchange apparatus has a cylinder-like fan shroud fixed with respect to the radiator and care is to be taken to avoid tipping the fan blade into the shroud. Most preferably, two springs are used and each spring has one end fixed with respect to the support and the other end fixed with respect to the carrier assembly. The springs urge the assembly in a belt-tensioning direction, i.e., in a direction such that the axis of rotation of the fan tends to be more distantly spaced from the axis of rotation of the crankshaft pulley. Such springs do so by acting along first and second force axes, respectively, and such axes are substantially parallel to a diametric axis of the shroud. That is, any out-of-parallelism will not amount to more than a few degrees.

In another aspect of the invention, the fan carrier assembly has a hollow, tube-like arbor fixed with respect to the panel. Two spaced-apart bearings are mounted in the arbor and support a shaft which extends through the arbor and the bearings and couples the fan and a driven fan pulley to one another.

The fan pulley has a pulley hub which, in a highly preferred embodiment for reduced overall length, is in axial overlapping relationship with the engine shaft, e.g., that shaft driving the water pump. Since the pulley hub is mounted with respect to the carrier assembly, both the hub and the assembly have the ability to move radially a small amount with respect to the shaft. To prevent the pulley hub from contacting the engine shaft, the hub includes a clearance opening for receiving the shaft. (As used herein, parts are in axial overlapping relationship when a plane perpendicular to the axis intersects the parts which are so related.)

In a specific embodiment, the only connection between the driving crankshaft pulley and the carrier assembly and its driven fan pulley is a flexible belt, e.g., a V-belt, engaging both pulleys. The crankshaft pulley rotates at engine speed and has a first diameter. The fan pulley has a second diameter greater than the first diameter, thereby causing the fan pulley to rotate at a speed less than engine speed to reduce fan tip noise. But the invention need not be used only to provide a fan speed less than engine speed. Given this specification, it will be apparent that a fan speed greater than that of the engine could readily be obtained to provide adequate cooling for, e.g., a slow-speed engine, as well as provide automatic belt tensioning.

Other aspects of the invention are set forth in the following detailed description and in the drawings.

DETAILED DESCRIPTION OF PREFERRED EMBODIMENTS

Figure 1:
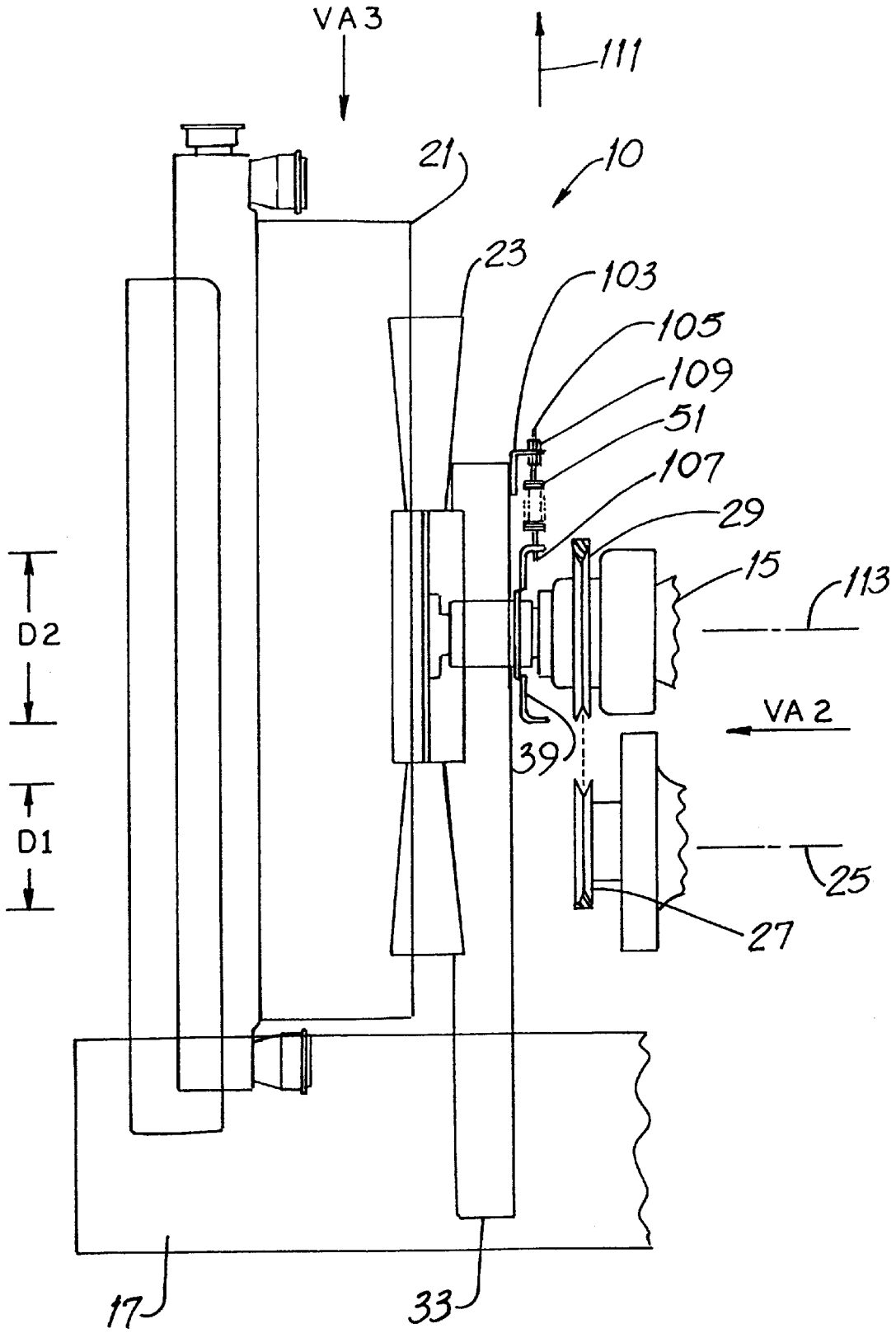
FIG. 1 is a side elevation view of the new heat exchange apparatus. Parts are shown in phantom and other parts are broken away.
Figure 2:
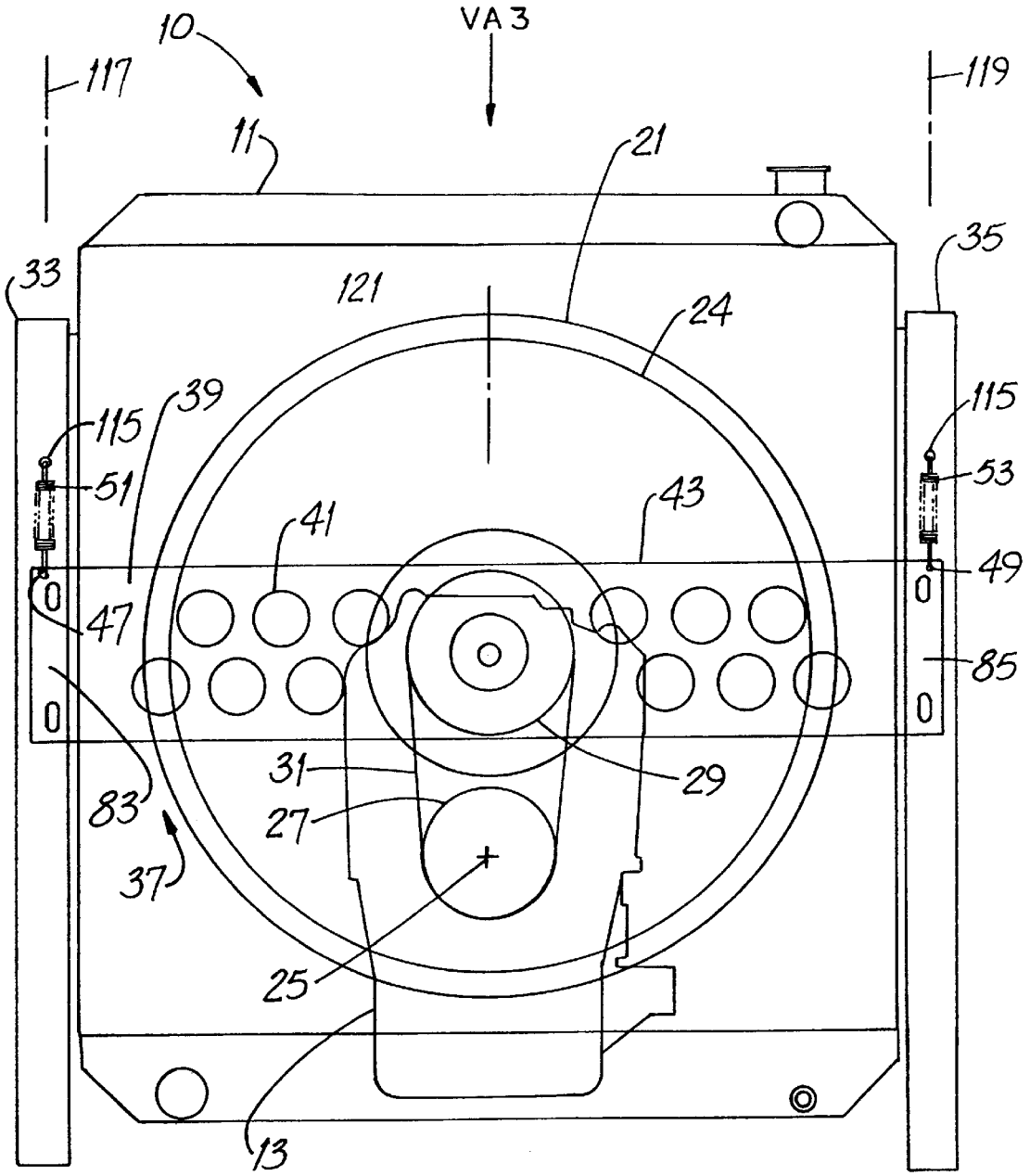
FIG. 2 is an elevation view of the apparatus of FIG. 1 taken along the viewing axis VA2 thereof. Parts are shown in phantom and surfaces of other parts are shown in dashed outline.
Figure 3:
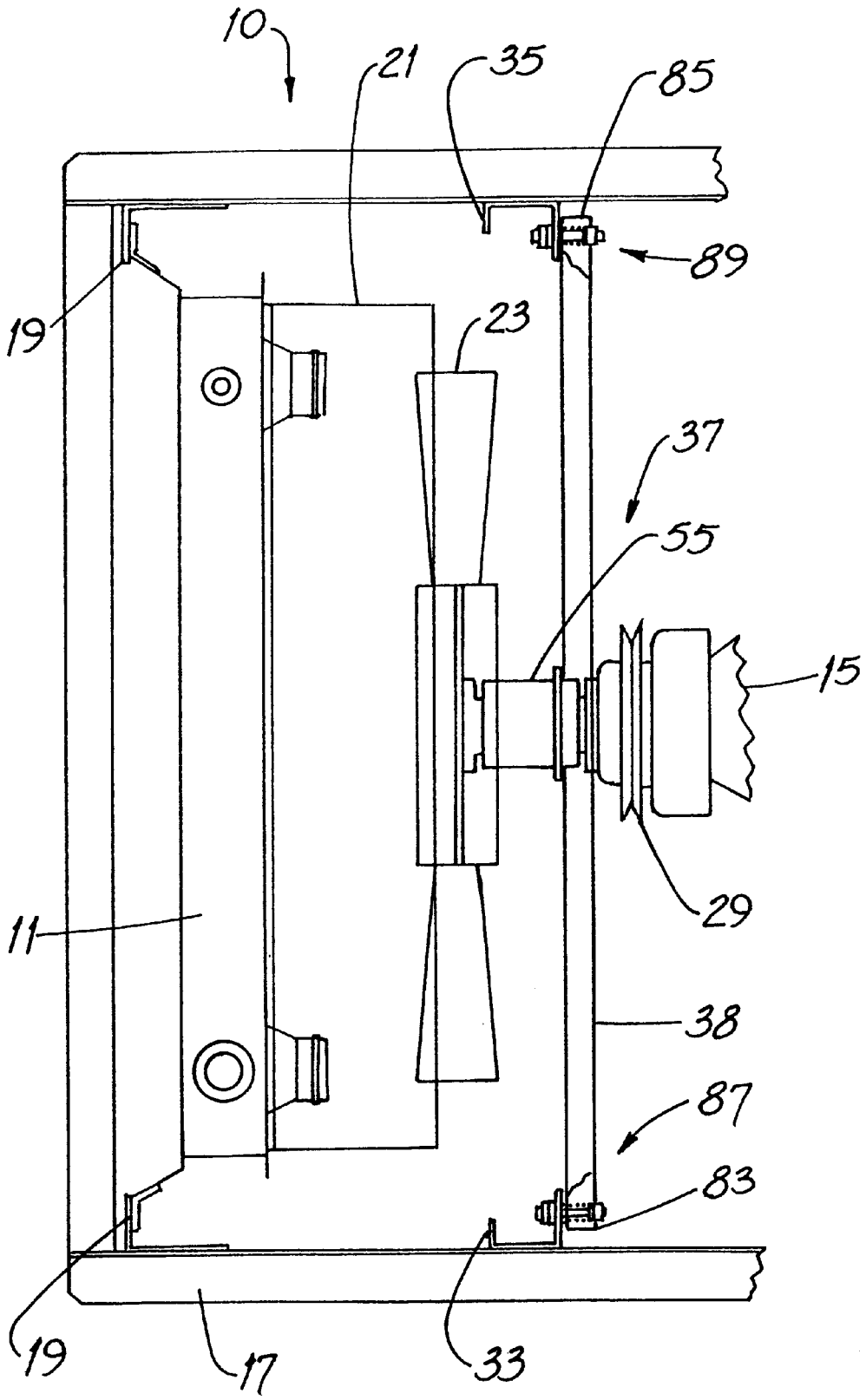
FIG. 3 is a top plan view of the apparatus of FIGS. 1 and 2 taken along the viewing axes VA3 thereof. Parts are shown in phantom and other parts are broken away.

Referring to FIGS. 1, 2 and 3, the heat exchange apparatus 10 includes a radiator 11 of the fin-and-tube type. Liquid used to cool the engine 13 is circulated by the pump 15 through the engine block coolant passages and through the spaced-apart tubes forming the radiator 11. Heat transfers from the liquid to the radiator tubes and fins and thence to the surrounding atmosphere. A fabricated mounting stand 17 is provided and the radiator 11 is rigidly supported by and affixed to the stand 17 using brackets 19 or the like. The radiator also includes a cylindrical, axially-short fan shroud 21 which dramatically increases the rate of air flow urged by the fan 23 through the radiator 11. (The trace 24 is defined by the tips of the fan blades.) The engine 13, also supported by and affixed to the stand, includes a crankshaft which rotates about the axis 25. Coupled to the crankshaft is a crankshaft pulley 27 which drives the fan pulley 29 using a V-belt 31 or the like.

Figure 5:
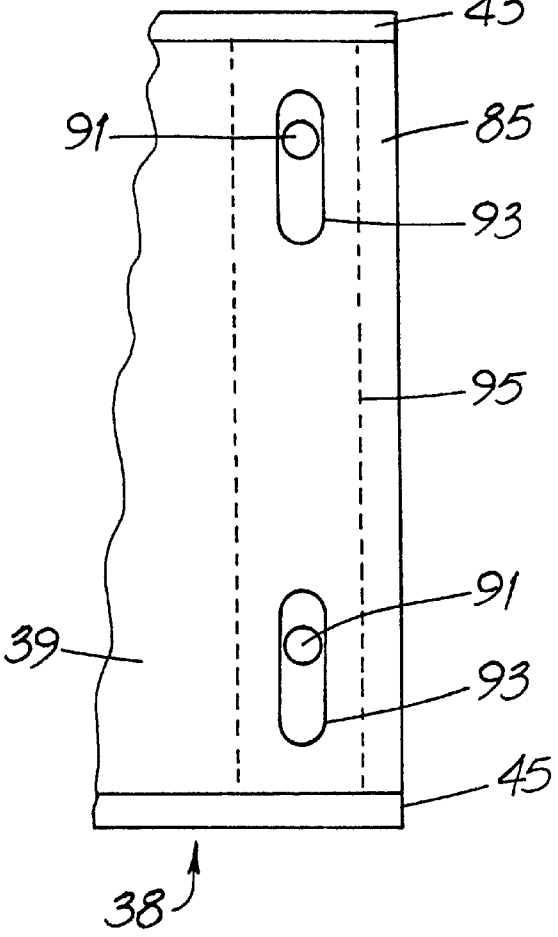
FIG. 5 is an elevation view of aspects of the pin-and-slot mechanism of FIG. 4 taken along the viewing axis VA5 thereof. Surfaces of a part are shown in dashed outline and another part is broken away.
Figure 4:
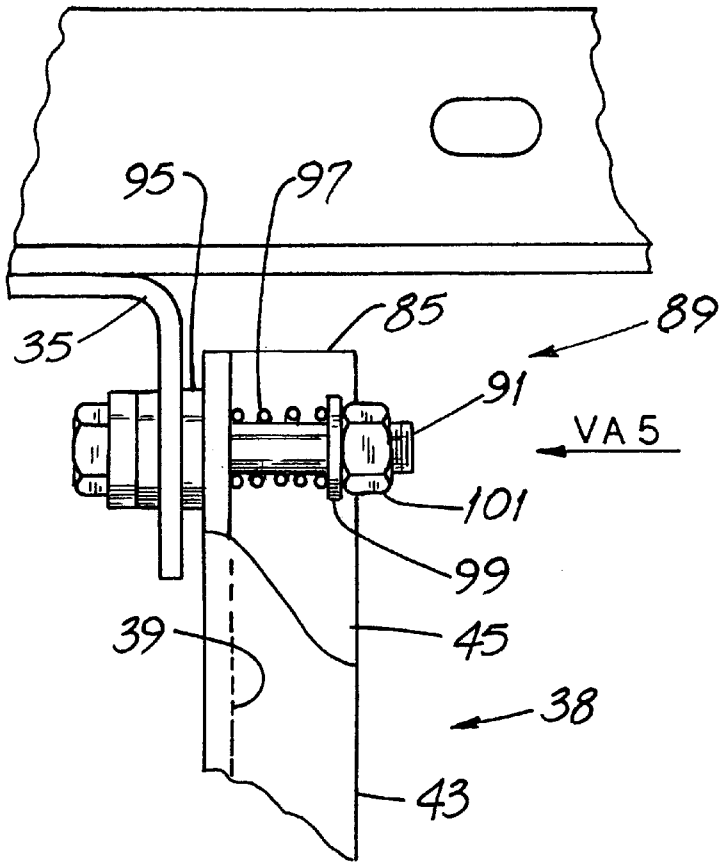
FIG. 4 is a top plan view of one of the pin-and-slot mechanisms used in the heat exchange apparatus. Surfaces of parts are shown in dashed outline, a part is shown in cross-section and other parts are broken away.

Upright, post-like first and second stanchions 33 and 35, respectively, are affixed to the mounting stand 17 and as described in more detail below, such stanchions 33, 35 support the fan carrier assembly 37 for translational sliding movement. Referring also to FIGS. 4 and 5, the assembly 37 includes a horizontally-elongate, rectangular panel 38 having a flat, vertical face portion 39 through which are formed a number of air flow apertures 41. Such apertures 41 help assure that air flowing through the shroud 21 and radiator 11 is not unduly impeded.

The panel 38 also has top and bottom edges 43, 45, respectively, projecting away from the portion 39 at right angles thereto. The edges 43, 45 impart additional rigidity to the panel 38 and as further described below, the top edge 43 provides first and second attachment points 47, 49, respectively, for first and second force members 51, 53, respectively, embodied as coiled tension springs. The upper ends of the members 51, 53 are anchored to the first and second stanchions 33, 35, respectively.

Figure 6:
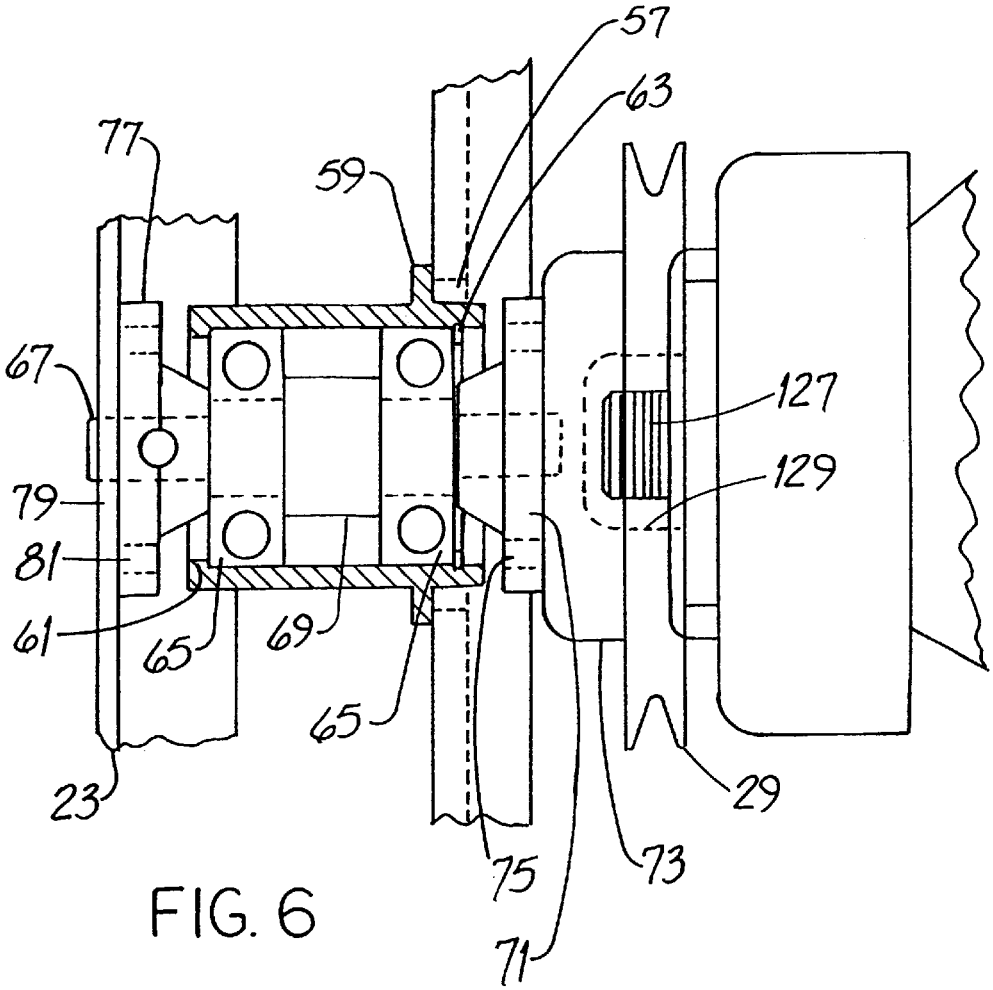
FIG. 6 is an enlarged top plan view, partly in section, of portions of the fan carrier assembly shown in FIGS. 1 and 3. Surfaces of parts are shown in dashed outline and other parts are broken away.

Referring also to FIG. 6, a hollow cylindrical arbor 55 extends through a central opening 57 in the vertical portion 39 and is rigidly affixed to such portion 39 by a mounting plate 59. The arbor 55 includes an annular, radiallyinwardly-projecting bearing retention shoulder 61 at one end and a snap ring groove 63 at the other. A pair of spaced-apart ball bearings 65 are received in the arbor 55 and rotatably support the fan drive shaft 67, the enlarged portion 69 of which maintains the bearings 65 in spaced relationship. (As will be recognized by those of ordinary skill in the art after appreciating this specification, The shoulder 61, the bearings 65, the portion 69 and the snap ring in the groove 63 cooperate to prevent significant axial movement of the shaft 67.)

A shaft coupling 71 and the hub 73 of the fan pulley 29 are attached to one another by bolts or the like extending through the openings 75. The fan coupling 77 is mounted to that end of the shaft 67 opposite the shaft coupling 71 and the fan coupling 77 and fan hub 79 are attached to one another by bolts through the openings 81.

Referring particularly to FIGS. 2, 3, 4 and 5, the first and second panel mounting portions 83, 85 and the stanchions 33, 35 are respectively connected to one another by first and second pin-and-slot mechanisms 87, 89. Since the mechanisms 87, 89 are substantially mirror images of one another, only the second mechanism 89 and its relationship to the second mounting portion 85 are described.

A highly preferred second mechanism 89 includes a pair of pins 91 (e.g., bolts), extending through respective round holes in the stanchion 35 and through respective elongated slots 93 in the second panel mounting portion 85. A slip pad 95 made of nylon or the like is interposed between the stanchion 35 and the portion 85 so that the carrier assembly 37 slides freely up and down with respect to the stanchions 33, 35.

A separate compression member 97, e.g., a coiled spring, is secured between the portion 85 and a washer 99 and nut 101 of each pin 91. Such compression members 97 urge the panel mounting portions 83, 85 against the slip pads 95. And the force members 51, 53 urge the carrier assembly 37 upwardly with respect to the engine 13 and pulley 27.

Referring next to FIGS. 1 and 2, the first and second stanchions 33, 35 have first and second anchor mounts 103 affixed thereto and since the mounts 103 are essentially identical to one another and are attached to the springs in the same way, only the first anchor mount 103 shown in FIG. 1 is described. A downwardly-extending eye bolt 105 is secured to the mount 103 and anchors one hook end of the force member 51. The other hook end 107 of the member 51 is inserted through an opening in the top edge 43. (It is to be appreciated that in an alternative arrangement, the force members 51, 53 can simply be hooked into holes 115 in the stanchions 33, 35, respectively.)

It is to be noted that adjusting nuts 109 permit the upward force provided by force member 51 to be adjusted. In that way, the forces exerted on the edge 43 by the members 51, 53 can be approximately equalized to help avoid the imposition of "cocking" force moments on the carrier assembly 37. And such forces can be adjusted to maintain the belt 31 at proper tension.

Referring to FIGS. 1 and 2, the members 51, 53 urge the assembly 37 in a belt-tensioning direction as indicated by the arrow 111, i.e., in a direction such that the axis of rotation 113 of the fan 23 tends to be more distantly spaced from the axis of rotation 25 of the crankshaft pulley 27. Such members 51, 53 do so by acting along first and second force axes 117, 119, respectively. In a specific arrangement, such axes 117, 119 are substantially parallel to a diametric axis 121 of the shroud 21. That is, any out-of-parallelism will not amount to more than a few degrees.

Figure 7:
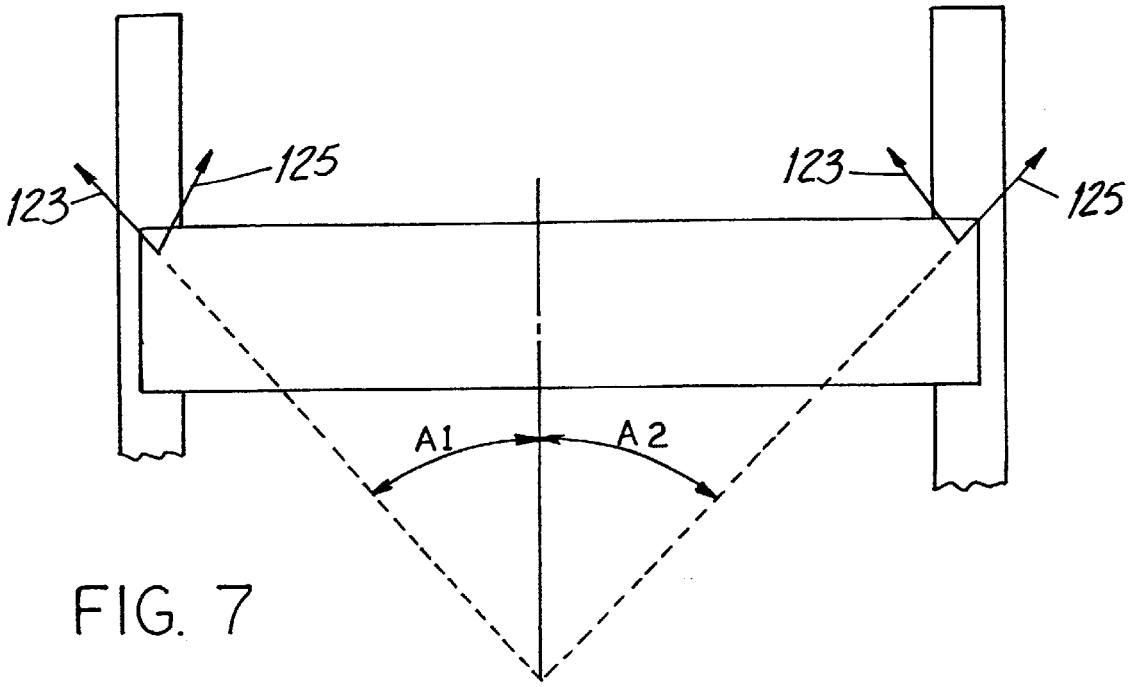
FIG. 7 is a representative elevation view showing the alternative directions of forces resulting from an alternate described embodiment.

Referring to FIGS. 1, 2 and 7, it is to be appreciated that the stanchions 33, 35 and carrier assembly 37 need not necessarily be configured so that the members 51, 53 act along force axes 117, 119 which are parallel to an axis 121 coincident with both axes 25, 113 of rotation. For example, angled slots 93 and angularly-acting force members 51, 53 could be used to urge the assembly 37 in a direction represented by the arrows 123 or by the arrows 125. Belt tensioning will result so long as the assembly 37 is urged in a direction defines an included angle A1 or A2 which is less (preferably substantially less) than 90°.

Referring particularly to FIG. 6, the hub 73 of the pulley 29 is, in a highly preferred embodiment, configured for reduced overall length in that the hub 73 is in axial overlapping relationship to the engine shaft 127. Since the pulley hub 73 is mounted with respect to the carrier assembly 37, both have the ability to move radially a small amount with respect to the engine shaft 127.

To prevent the pulley hub 73 and engine shaft 127 from contacting one another, the hub 73 includes a clearance opening 129 for receiving the shaft 127. In that way, the carrier assembly 37 (including the hub 73) can, under the urging of the members 51, 53 move incrementally to a position slightly out of concentricity with the shaft 127 and still avoid contacting such shaft 127.

Referring next to FIGS. 1 and 2, the only connection between the driving crankshaft pulley 27 and the carrier assembly 37 and its driven fan pulley 29 is the V-belt 31 engaging both pulleys 27, 29. The crankshaft pulley 27 rotates at engine speed and has a first diameter D1. The fan pulley 29 has a second diameter D2 greater than the first diameter D1, thereby causing the fan pulley 29 to rotate at a speed less than engine speed to reduce fan tip noise. But the invention need not be used only to provide a fan speed less than engine speed. Given this specification, it will be apparent that a fan speed greater than that of the engine 13 could readily be obtained to provide adequate cooling for, e.g., a very-low-speed engine 13.

After appreciating the foregoing, it will be apparent that the new apparatus 10 permits a heat exchanger fan 23 to be driven at a speed significantly less than that of the engine 13. Fan noise is thereby reduced. And the new apparatus 10 also provides automatic belt tensioning.

While the principles of the invention have been shown and described in connection with specific embodiments, it is to be understood clearly that such embodiments are by way of example and are not limiting.

What is claimed:

1. In the combination of a heat exchange apparatus and a liquid-cooled internal combustion engine having an auxiliary engine shaft and a crankshaft pulley, the apparatus including a radiator and a belt-driven fan, the improvement comprising:

a fan support fixed with respect to the radiator;

a fan carrier assembly having the fan mounted thereon, the carrier assembly being slide-mounted for linear motion with respect to the support and having a force member urging the assembly and the fan mounted thereon in a belt-tensioning direction away from the crankshaft pulley.

2. The combination of claim 1 wherein:

the fan support includes spaced-apart first and second stanchions;

the fan carrier assembly includes a panel extending between the stanchions and having first and second spaced mounting portions linearly slide-mounted with respect to the first and second stanchions, respectively.

3. The combination of claim 2 wherein the first and second mounting portions are slide-mounted to the first and second stanchions, respectively, by first and second pin-and-slot mechanisms, respectively.

4. The combination of claim 3 wherein the first pin-and-slot mechanism includes a pin fixed with respect to the first stanchion and a slot in the first mounting portion.

5. The combination of claim 3 wherein the first pin-and-slot mechanism includes a pin fixed with respect to the first mounting portion and a slot in the first stanchion.

6. The combination of claim 1 further including a fan shroud fixed with respect to the radiator and wherein:

the force member is a first force member and the apparatus includes a second force member urging the assembly in a belt-tensioning direction;

the shroud has a diametric axis;

the force members act along first and second force axes, respectively; and the force axes are substantially parallel to the diametric axis.

7. The combination of claim 6 wherein each force member includes a coil spring having a first end fixed with respect to the support and a second end fixed with respect to the carrier assembly.

8. The combination of claim 1 wherein:

the fan support includes spaced-apart first and second stanchions;

the fan carrier assembly includes a panel extending between the stanchions and an arbor fixed with respect to the panel;

a bearing-supported shaft extends through the arbor and couples the fan and a driven fan pulley to one another.

9. The combination of claim 6 wherein:

the fan support includes spaced-apart first and second stanchions;

the fan carrier assembly includes a panel extending between the stanchions and an arbor fixed with respect to the panel;

a bearing-supported shaft extends through the arbor and couples the fan and a driven fan pulley to one another.

10. The combination of claim 1 wherein:

the fan is belt-driven through a fan pulley having a pulley hub;

the hub is in axial overlapping relationship with the engine shaft and includes a clearance opening for receiving the shaft.

11. The combination of claim 10 wherein:

a flexible belt is driven by the crankshaft pulley and drives the fan pulley;

the crankshaft pulley rotates at engine speed and has a first diameter;

the fan pulley has a second diameter greater than the first diameter, thereby causing the fan pulley to rotate at a speed less than engine speed.

12. The combination of claim 11 further including a fan shroud fixed with respect to the radiator and wherein:

the force member is a first force member and the apparatus includes a second force member urging the assembly in a belt-tensioning direction;

the shroud has a diametric axis;

the force members act along first and second force axes, respectively; and the force axes are substantially parallel to the diametric axis.

13. In the combination of a heat exchange apparatus and a liquid-cooled internal combustion engine having an auxiliary engine shaft and a crankshaft pulley, the apparatus including a radiator and a belt-driven fan, the improvement comprising:

a fan support fixed with respect to the radiator;

a fan carrier assembly having the fan mounted thereon, the carrier assembly being slide-mounted with respect to the support and having a force member urging the assembly in a belt-tensioning direction; and wherein:

the fan support includes spaced-apart first and second stanchions;

the fan carrier assembly includes a panel extending between the stanchions and having first and second spaced mounting portions slide-mounted to the first and second stanchions, respectively, by first and second pin-and-slot mechanisms, respectively.

14. The combination of claim 13 wherein the first pin-and-slot mechanism includes a pin fixed with respect to the first stanchion and a slot in the first mounting portion.

15. The combination of claim 13 wherein the first pin-and-slot mechanism includes a pin fixed with respect to the first mounting portion and a slot in the first stanchion.

16. In the combination of a heat exchange apparatus and a liquid-cooled internal combustion engine having an auxiliary engine shaft and a crankshaft pulley, the apparatus including a radiator and a belt-driven fan, the improvement comprising:

a fan support fixed with respect to the radiator;

a fan carrier assembly having the fan mounted thereon, the carrier assembly being slide-mounted with respect to the support and having first and second force members urging the assembly in a belt-tensioning direction;

a fan shroud fixed with respect to the radiator; and wherein:

the shroud has a diametric axis;

the force members act along first and second force axes, respectively; and the force axes are substantially parallel to the diametric axis.

17. The combination of claim 16 wherein each force member includes a respective coil spring having a first end fixed with respect to the support and a second end fixed with respect to the carrier assembly.

18. In the combination of a heat exchange apparatus and a liquid-cooled internal combustion engine having an auxiliary engine shaft and a crankshaft pulley, the apparatus including a radiator and a belt-driven fan, the improvement comprising:

a fan support fixed with respect to the radiator and having spaced-apart first and second stanchions;

a fan carrier assembly having the fan mounted thereon, the carrier assembly being slide-mounted with respect to the support and having a force member urging the assembly in a belt-tensioning direction; and wherein:

the fan carrier assembly includes a panel extending between the stanchions and an arbor fixed with respect to the panel; and a bearing-supported shaft extends through the arbor and couples the fan and a driven fan pulley to one another.

19. In the combination of a heat exchange apparatus and a liquid-cooled internal combustion engine having an auxiliary engine shaft and a crankshaft pulley, the apparatus including a radiator and a belt-driven fan, the improvement comprising:

a fan support fixed with respect to the radiator;

a fan carrier assembly having the fan mounted thereon, the carrier assembly being slide-mounted with respect to the support and having a force member urging the assembly in a belt-tensioning direction; and wherein:

the fan is belt-driven through a fan pulley;

the belt is a flexible belt which is driven by the crankshaft pulley and which drives the fan pulley;

the crankshaft pulley rotates at engine speed and has a first diameter;

the fan pulley has a second diameter greater than the first diameter, thereby causing the fan pulley to rotate at a speed less than engine speed.

20. The combination of claim 19 wherein:

the fan pulley has a pulley hub;

the hub is in axial overlapping relationship with the engine shaft and includes a clearance opening for receiving the shaft.

* * * * *